US007155923B2

(12) United States Patent
Nam et al.

(10) Patent No.: US 7,155,923 B2
(45) Date of Patent: Jan. 2, 2007

(54) REFRIGERATOR WITH TELEVISION

(75) Inventors: Young-Sok Nam, Seoul (KR); Seong-Ho Cho, Seoul (KR); Jay-Ho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 80 days.

(21) Appl. No.: 10/968,188

(22) Filed: Oct. 20, 2004

(65) Prior Publication Data

US 2005/0097912 A1 May 12, 2005

(30) Foreign Application Priority Data

Nov. 7, 2003 (KR) ..... 10-2003-0078758

(51) Int. Cl.
*F25D 23/12* (2006.01)

(52) U.S. Cl. ..... 62/259.2; 62/331; 165/80.3

(58) Field of Classification Search ..... 62/331, 62/259.2, 3.1–3.6; 348/61, 739, 836; 165/80.3; 361/690–697
See application file for complete search history.

(56) References Cited

U.S. PATENT DOCUMENTS 3,823,567 A * 7/1974 Corini ..... 62/3.6
4,571,740 A * 2/1986 Kirby et al. ..... 455/344
5,315,830 A * 5/1994 Doke et al. ..... 62/3.2
5,605,047 A * 2/1997 Park et al. ..... 62/3.6
6,164,369 A * 12/2000 Stoller ..... 165/104.33
6,442,952 B1 * 9/2002 Roh et al. ..... 62/127
6,483,695 B1 * 11/2002 Hartstein ..... 361/680
6,809,295 B1 * 10/2004 Vargas ..... 219/393
6,853,399 B1 * 2/2005 Gilman et al. ..... 348/61

FOREIGN PATENT DOCUMENTS

| | | | |
|---|---|---|---|
| AU | 199855345 A1 | | 6/2000 |
| JP | 406350941 A | * | 12/1994 |
| JP | 7-318237 A | | 12/1995 |
| JP | 9250868 | | 9/1997 |
| JP | 2001-289555 A | | 10/2001 |

* cited by examiner

*Primary Examiner*—William E. Tapolcai
(74) *Attorney, Agent, or Firm*—Birch, Stewart, Kolasch & Birch, LLP

(57) ABSTRACT

A refrigerator includes a main body provide with a storage compartment and a door for opening and closing the compartment, a display unit installed on the door, for displaying an image of a television, and a heat discharging unit installed at one side of the display unit, for releasing heat generated from the display unit. Accordingly, overheating of the display unit and deterioration of refrigeration performance can be prevented.

26 Claims, 6 Drawing Sheets

REFRIGERATOR WITH TELEVISION

This Non-provisional application claims priority under 35 U.S.C. § 119(a) on Patent application No(s). 10-2003-007875 8 filed in Korea, Republic of on Nov. 7, 2003, the entire contents of which are hereby incorporated by reference.

BACKGROUND OF THE INVENTION

1. Field of the Invention

The present invention relates to a refrigerator and, more particularly, to a refrigerator capable of improving convenience to a kitchen by installing a television in a door of the refrigerator.

2. Description of the Background Art

Recently, in the field of household appliances, multifunctions, that is, providing a variety of functions in one product while achieving a high function for which the product is primarily intended, is always being investigated. Such attempts are the result that the market for household appliances is saturated and thus efforts to provide superior and more convenient products through the continuous development of technologies are always being considered.

According to such tendencies, in the case of a household refrigerator, various functions are being added, i.e., a dispenser for dispensing ice or water is mounted at one side of a door, or the Internet is connected to another side of the door.

Technology, wherein the Internet is connected to a refrigerator, has been expected to contribute to changing a kitchen which has been most devoid of information to a house with an up-to-data information-oriented space. Namely, as the Internet is connected to the refrigerator, various information, such as one for cooking information can be obtained at any time, and information can be continuously exchanged via short distance communication.

However, since such a refrigerator requires high technology in comparison to its effective value, the cost of products is increased. Due to this, there is a limit to use it for a general purpose. Accordingly, new technology is required to obtain various information with the low cost.

SUMMARY OF THE INVENTION

An object of the present invention is to provide a refrigerator which increase the conveniences of life and prevents a deterioration of the refrigeration performance caused by an installation of a display unit by providing the refrigerator with the display unit for displaying an image from a television on a door and a heat discharging unit for releasing heat generated from the display is unit to the outside.

To achieve these and other advantages and in accordance with the purpose of the present invention, as embodied and broadly described herein, a refrigerator includes: a main body provide with a storage compartment and a door for opening and closing the compartment; a display unit installed on the door, for displaying an image of a television; and a heat discharging unit installed at one side of the display unit, for releasing heat generated from the display unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the present invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, the preferred embodiments of the present invention will be described in detail with reference to the accompanying drawings.

Figure 1:
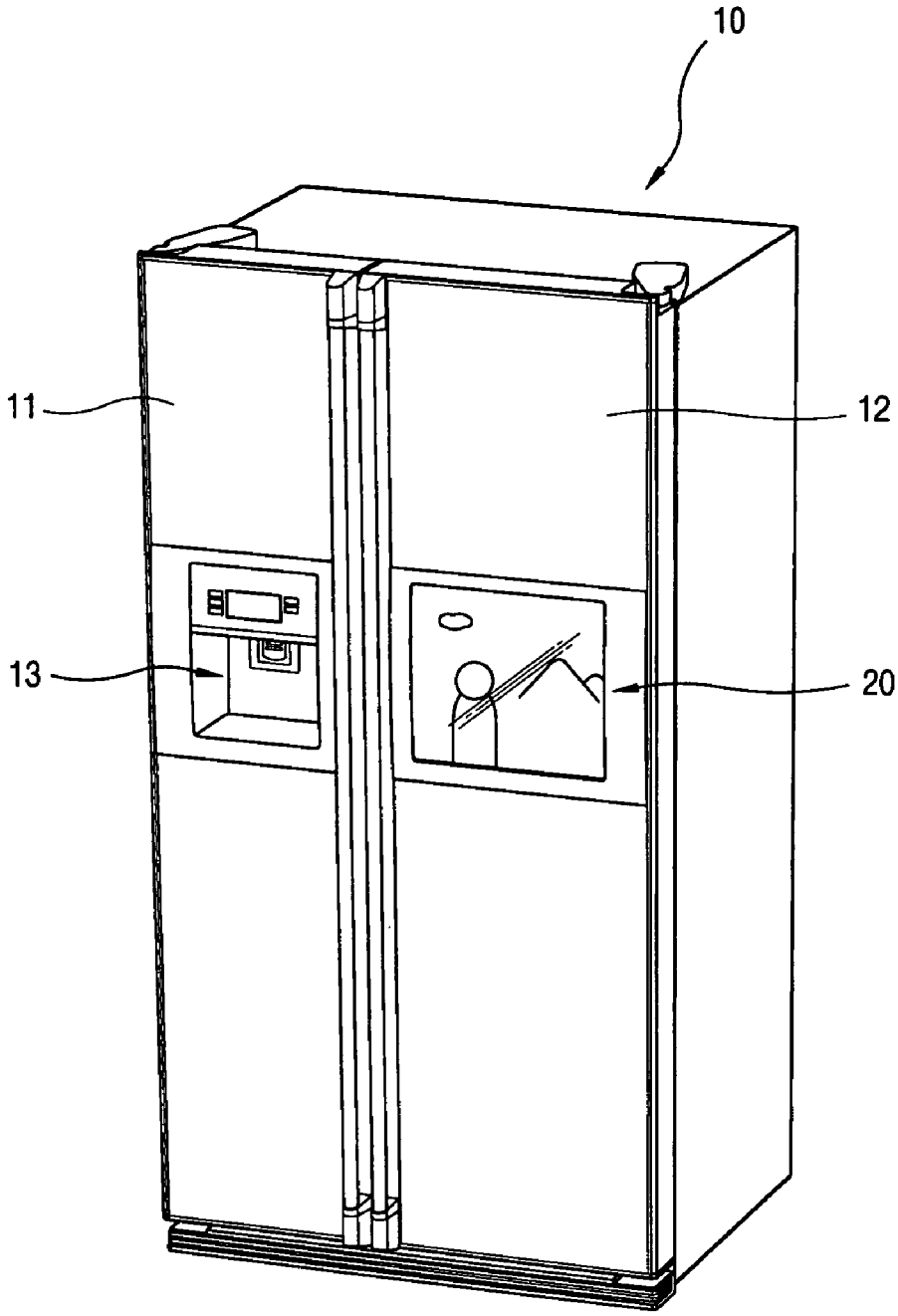
FIG. 1 is a perspective view of a refrigerator in accordance with the present invention.

As shown in FIG. 1, a refrigerator according to the present invention includes: a main body 10 provided with a storage compartment therein; doors 11 and 12 for opening/closing the freezing chamber and the refrigerating chamber respectively, installed at the main body 10; a dispenser 13 for dispensing water or ice, installed at the door 11; and a display unit 20 for displaying an image of a television, installed in the door 12.

Figure 2:
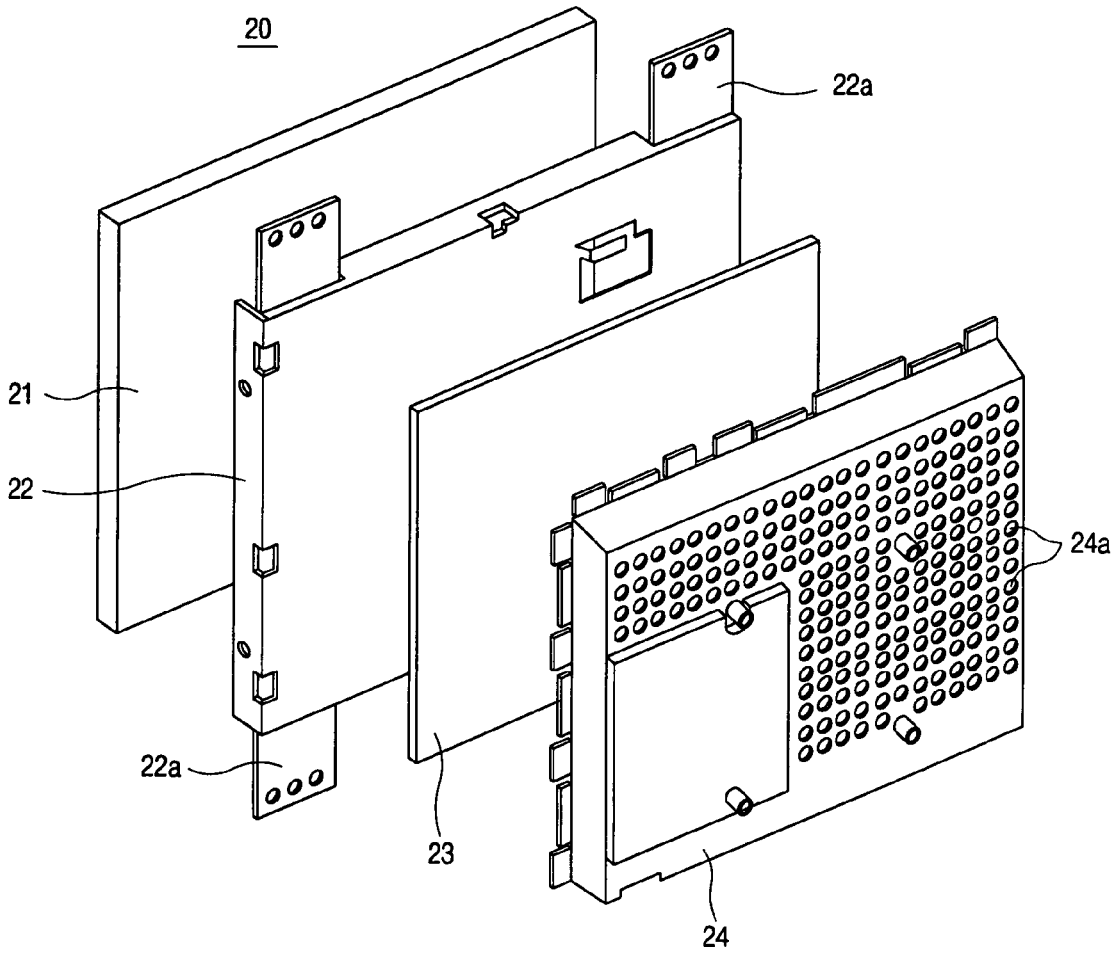
FIG. 2 is a disassembled perspective view showing a display unit provided in a refrigerator in accordance with the present invention.

As shown in FIG. 2, the display unit 20 includes: a display panel 21 for displaying an image; a fixing plate 22 for supporting the display panel 21, from which a plurality of brackets 22*a* are extended to fix the display unit 20 to the door 12; an electronic circuit board 23 for controlling the display panel 21; and a shield plate 24 installed to cover the electronic circuit board 23, shielding an electromagnetic wave, and provided with a plurality of through holes 24*a* to release heat generated from the electronic circuit board 23 to the outside. An LCD (liquid crystal display) panel is preferably used as the display panel 21.

A refrigerator with the display unit 20 facilitates TV watching in a kitchen, and is capable of easily transferring information on cooking and current affairs to users. In installing the display unit 20 in the refrigerator, one of design factors importantly taken into account is heat discharged from the display unit 20. The heat released from the display unit 20 can deteriorate the performance of a circuit system for receiving and controlling an image of a television. Besides, the heat can be transferred in the freezing chamber and the refrigerating chamber, resulting in a degradation of the refrigeration performance of the refrigerator. In the present invention, there is provided a radiation structure for releasing heat generated from the display unit 20.

Figure 3:
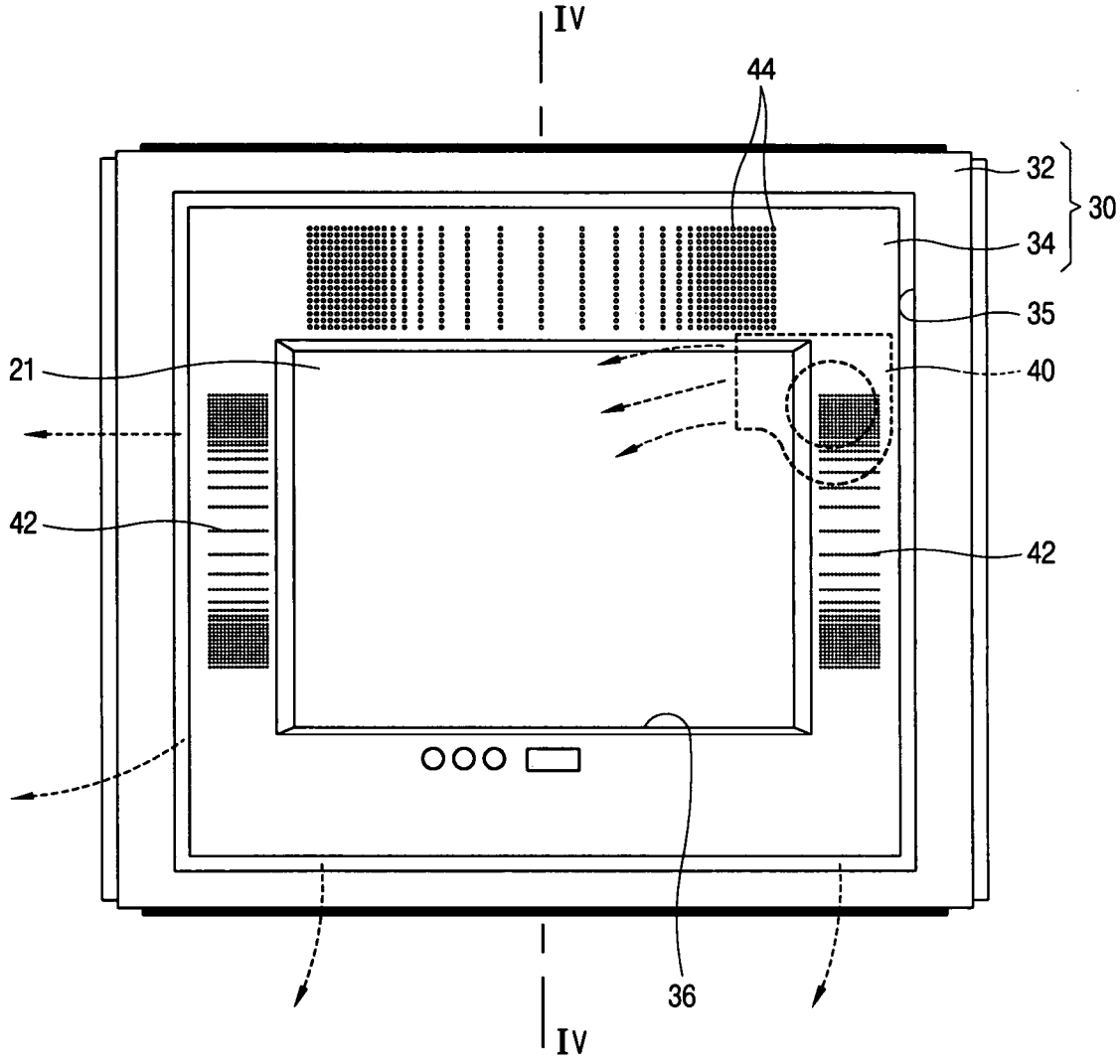
FIG. 3 is a front view showing the display unit provided in the refrigerator in accordance with one embodiment of the present invention.
Figure 4:
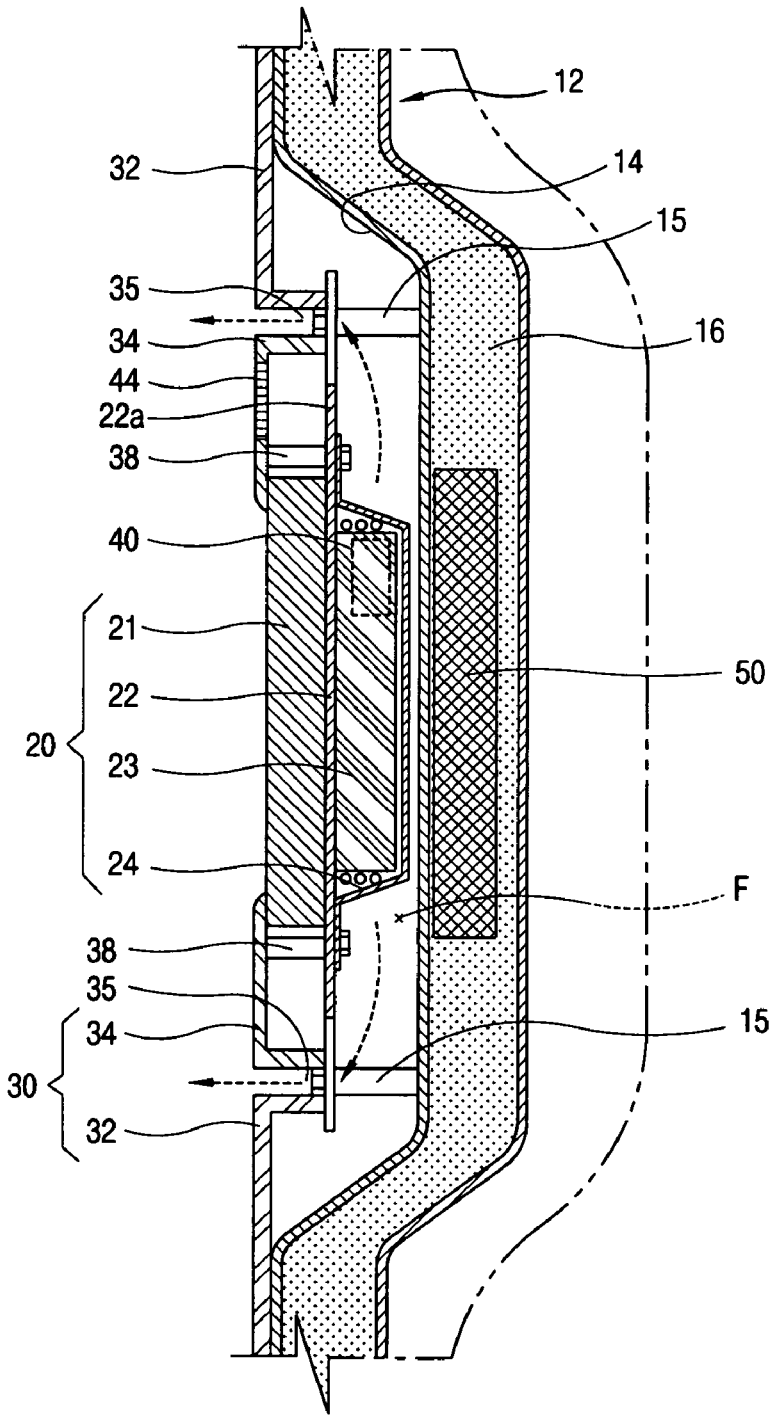
FIG. 4 is a cross-sectional view taken along line IV—IV of FIG. 3.

As shown in FIGS. 3 and 4, the display unit 20 is installed leaving a predetermined distance from an accommodating portion 14 in order that a flow path F where air for releasing heat flows between the display unit 20 and the accommodating portion 14 recessed in an inner side of the door 12 is formed. In a front surface of the door mounted with the display unit 20, a cover plate 30 is installed to cover a space between the display unit 20 and the accommodating portion 14.

A stud 15 for supporting the display unit 20 to the accommodating portion 14 and maintaining an interval between the display unit 20 and the accommodating portion 14 is installed between the display unit 20 and the accommodating portion 14 by being connected to the brackets 22*a* of the fixing plate 22.

A plurality of air paths 42 and 44 communicated with the flow path F are formed at the cover plate 30. According to this, exterior air of the main body 10 flows in the flow path F through the air paths 42 and 44, and air heated by heat generated from the display unit 20 is discharged to the outside through the air paths 42 and 44. The air paths 42 and 44 are preferably formed to be as fine as about 2 mm in order to prevent exterior foreign materials from coming in.

The cover plate 30 includes a first cover plate 32 having a space therein and a second cover plate 34 disposed in the space of the first cover plate 32 to form a gap 35 and provided with an exposing portion 36 where the screen of the display panel 21 is exposed.

The first and second cover plates 32 and 34 are fixed to the brackets 22*a* of the fixing plate 22 of the display unit 20. The stud 38 for maintaining an interval between the second cover plate 34 and the fixing plate 22 is interposed between the second cover plate 34 and the fixing plate 22 in order to safely position the display panel 21.

The gap 35 between the first cover plate 32 and the second cover plate 34 communicates with the flow path F. Accordingly, exterior air of the main body 10 flows in the flow path F through the gap 35, and air heated by heat generated from the display unit 20 is discharged from the gap 35.

Meanwhile, in order to prevent heat generated from the display unit 20 from passing through the door 12 and being transferred into the refrigerating chamber, the thicknesses of the door 12 and an insulation member 16 in the door 12 can be increased, but there is a limit to volumes of the refrigerating chamber and the freezing chamber.

To solve this problem, a vacuum insulation member 50 of which the inside is vacuumized, is preferably installed at a region of the door 12 corresponding to the display unit.

According to such construction, air is circulated in the flow path F through air paths 42 and 44 of the cover plate 30, so that heat generated from the display unit 20 is effectively released to the outside. Accordingly, overheating of the display unit 20 and deterioration of refrigeration performance which results from the installation of the display unit 20 can be prevented.

Meanwhile, in order to release heat generated from the display unit 20 more effectively, a heat discharging unit for releasing heat by force is preferably installed. Hereinafter, such heat discharging unit will be presented through each embodiment.

Thus, a blower 40 for circulating air in the flow path F by force is preferably installed as the heat discharging unit of one embodiment. The blower 40 is structured to have a centrifugal fan in order to evenly circulate air between the display unit 20 and the accommodating portion 14.

Because of the operation of the blower 40, air is forced to circulate through the flow path F, the air paths 42 and 44, and the gap 35 formed by the first cover plate 32 and the second cover plate 34, so that heat generated when the display unit 20 operates is effectively released to the outside. Accordingly, overheating of the display unit 20 can be prevented, and deterioration of the refrigeration performance can be more effectively prevented.

Hereinafter, with reference to FIGS. 5 and 6, another embodiment of a heat discharging unit for releasing heat generated from the display unit 20 will be described.

Figure 5:
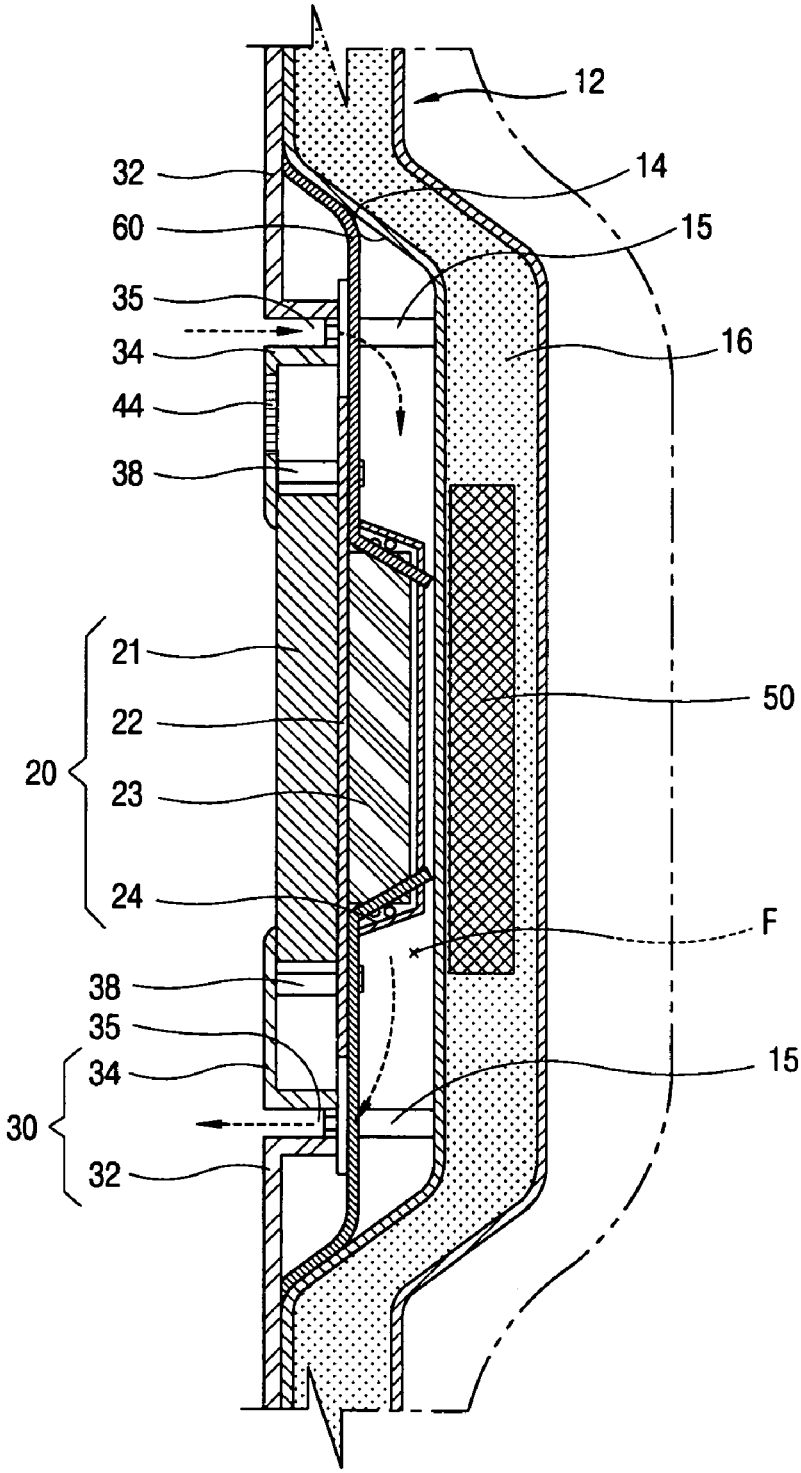
FIG. 5 is a cross-sectional view showing a structure of the display unit of the refrigerator in accordance with another embodiment of the present invention.

As shown in FIG. 5, the heat discharging unit according to another embodiment of the present invention comprises a platy heat conducting member 60 connected from the metal plate material or made of the separate metal plate material. The platy heat conducting member 60 contacts the display unit 20, particularly, the heating portion of the circuit board 23 and extends toward the front surface of the door 12 where it releases the heat of the display unit 20 to the outside.

The heat discharging unit according to another embodiment of the present invention consists of the platy heat conducting member 60, so that it has an advantage that the structure is very simple.

Figure 6:
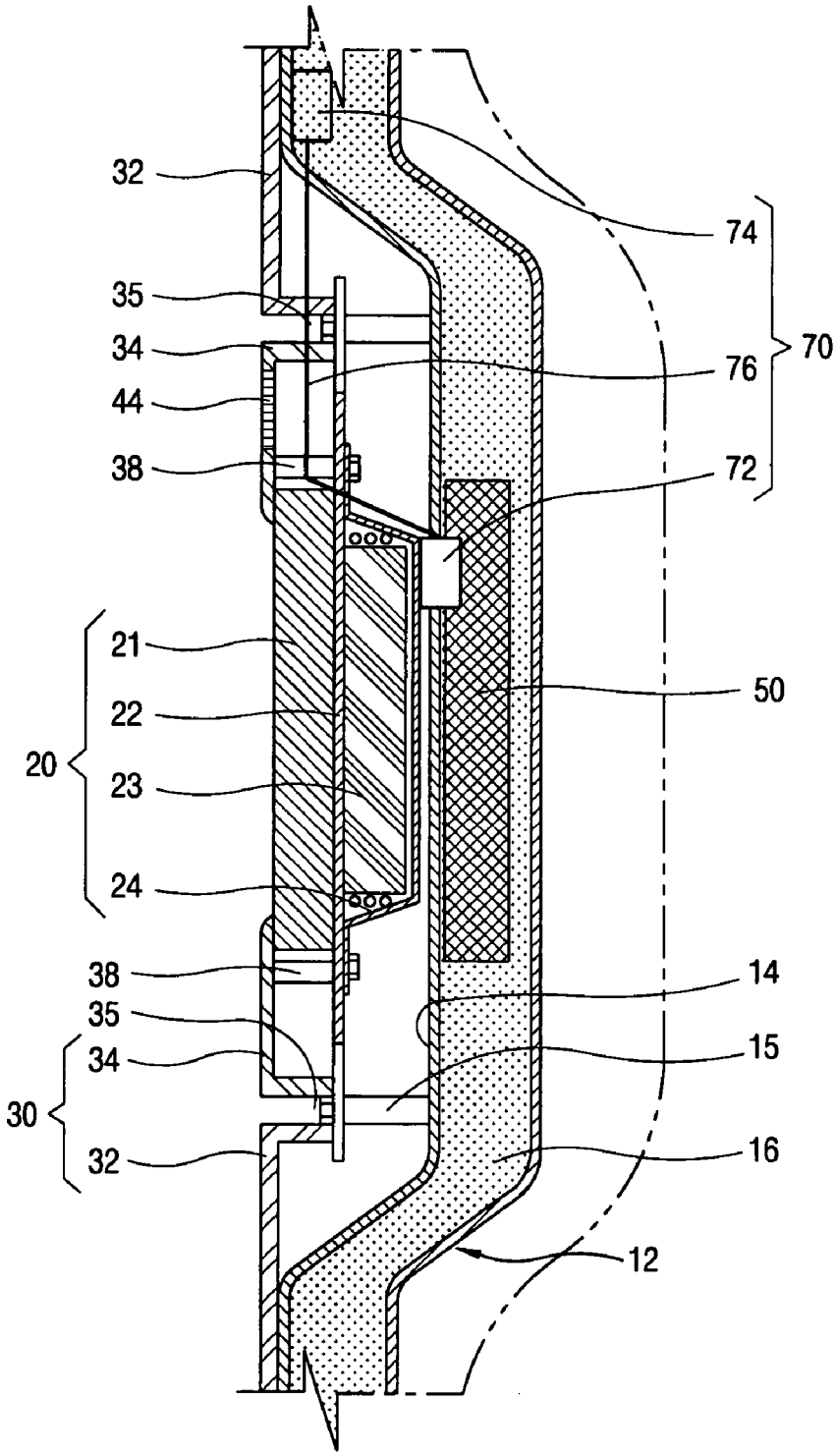
FIG. 6 is a cross-sectional view showing a structure of the display unit of the refrigerator in accordance with still another embodiment of the present invention.

In addition, as shown in FIG. 6, the heat discharging unit according to still another embodiment of the present invention includes a heat pipe 70 comprising: a heat absorbing member 72 for intensively absorbing heat generated from the heating portion, installed adjacent to the heating portion of the display unit 20; a heat radiating member 74 installed at a front surface of the door around the display unit 20; and a connecting member 76 connected to the heat absorbing member 72 and the heat radiating member 74 respectively and transferring heat absorbed in the heat absorbing member 72 toward the heat radiating member 74.

The heat pipe 70 has a structure wherein a fluid is contained within a metal material. The fluid in the heat absorbing member 72 is vaporized by heat generated from the display unit 20. The vaporized fluid is transferred to the heat radiating member 74 through the connecting member 76 and heat-exchanged with the outside of the main body so as to be condensed. The condensed fluid is re-circulated to the heat absorbing member 72. With such principle, an operation for releasing heat is performed.

The heat discharging unit provided with the refrigerator according to still another embodiment can be focused on the heating portion of the display unit 20, so that it can remove the disadvantages that a structure for releasing heat is complicated and the material cost is increased.

Technical spirits of each heat discharging unit separately described in each embodiment can not only be divided to be applied, but also can be mixed to be applied.

In a refrigerator according to the present invention, a display unit is installed, so that convenience to a kitchen can be improved. In addition, a heat radiating structure and a heat discharging unit in which heat generated from the display unit is effectively discharged, is provided, so that overheating of the display unit and deterioration of refrigeration performance can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator, comprising:

a main body provided with a storage compartment and a door for opening and closing the compartment;

a display unit installed on the door, for displaying an image; and a heat discharging unit which has a heat conducting member in contact with the display unit installed at one side of the display unit, for releasing heat generated from the display unit.

2. The refrigerator of claim 1, wherein the display unit is installed at a distance from an accommodating portion recessed in the door in order to form a flow path for releasing heat flows; and the heat discharging unit includes a blower for circulating air in the flow path.

3. The refrigerator of claim 2, wherein a cover plate is installed at a front surface of the door in order to cover a space between the display unit and the accommodating portion of the door.

4. The refrigerator of claim 3, wherein air paths are formed in the cover plate, said air paths communicating with the flow path.

5. The refrigerator of claim 3, wherein the cover plate comprises:

a first cover plate having a space therein; and a second cover plate portion disposed in the space of the first cover plate so as to form a gap from the first cover plate portion and provided with an exposing portion where a screen of the display unit is exposed to the exterior.

6. The refrigerator of claim 5, wherein the gap between the first cover plate portion and the second cover plate portion communicates with the flow path.

7. The refrigerator of claim 2, wherein a stud for supporting the display unit to the accommodating portion and maintaining an interval for the flow path is installed between the display unit and the accommodating portion.

8. The refrigerator of claim 1, wherein the heat discharging unit comprises:

a heat absorbing member installed adjacent to a heating generating portion of the display unit, for absorbing heat generated from the display unit;

a heat radiating member installed at a front surface of the door; and a connecting member connected to the heat absorbing member and the heat radiating member, for transferring heat absorbed in the heat absorbing member toward the heat radiating member.

9. The refrigerator of claim 1, wherein a vacuum insulation member of which the inside is vacuumized is installed at a region of the door corresponding to the display unit.

10. The refrigerator of claim 1, wherein the display unit comprises:

a display panel for displaying an image;

a fixing plate fixed to the door and supporting the display panel;

an electronic circuit board for controlling the display panel; and a shield plate installed to cover the electronic circuit board, for shielding electromagnetic waves.

11. The refrigerator of claim 10, wherein the shield plate has a plurality of through holes for cooling.

12. The refrigerator of claim 1, wherein the display unit is installed at a distance from the door in order to form a flow path where air for releasing heat flows, the heat discharging unit including a blower for circulating air in the flow path.

13. The refrigerator of claim 12, further comprising:

a heat conducting means installed adjacent to the display unit and extended toward a front surface of the door, for releasing heat generated from the display unit.

14. The refrigerator of claim 13, wherein the heat conducting means is formed with a metallic plate.

15. The refrigerator of claim 13, wherein the heat conducting means comprises:

a heat absorbing member installed adjacent to a heating portion of the display unit, for absorbing heat generated from the display unit;

a heat radiating member installed at a front surface of the door; and a connecting member connected to the heat absorbing member and the heat radiating member, for transferring heat absorbed in the heat absorbing member toward the heat radiating member.

16. The refrigerator of claim 12, wherein a vacuum insulation member of which the inside is vacuumized is installed at a region of the door corresponding to the display unit.

17. The refrigerator of claim 1, wherein the said display unit being installed at a distance from an accommodating portion recessed in the door in order to form a flow path where air for releasing heat flows; and a cover plate is installed at a front surface of the door in order to cover a space between the display unit and the accommodating portion of the door.

18. The refrigerator of claim 17, wherein the cover plate comprises:

a first cover plate portion having a space therein; and a second cover plate portion disposed in the space of the first cover plate so as to form a gap which communicates with the flow path.

19. The refrigerator of claim 17, wherein a vacuum insulation member of which the inside is vacuumized is installed at a region of the door corresponding to the display unit.

20. A refrigerator, comprising:

a main body provided with a storage compartment and a door for opening and closing the compartment;

a display unit installed on the door, for displaying an image; and a heat discharging unit which has a heat conducting member in contact with the display unit installed at one side of the display unit, for releasing heat generated from the display unit;

wherein the heat discharging unit comprises:

a heat absorbing member installed adjacent to a heating generating portion of the display unit, for absorbing heat generated from the display unit;

a heat radiating member installed at a front surface of the door; and a connecting member connected to the heat absorbing member and the heat radiating member, for transferring heat absorbed in the heat absorbing member toward the heat radiating member.

21. The refrigerator of claim 20, wherein the heat absorbing member contains a fluid which is vaporized by the heat generated from the display unit, transferred through the connecting member to the heat radiating member where it is condensed and returned to the heat absorbing member.

22. A refrigerator comprising a main body provided with a storage compartment and a door for opening and closing the compartment, a display unit installed in the door for displaying an image on a screen, and a heat discharging unit operatively associated with the display unit for releasing heat generated by the display unit, wherein the heat discharging unit includes an accommodating portion recessed in the door and spaced apart from the rear of the display unit to form an air flow path for releasing heat flows at the lateral sides of the screen, and the heat discharging unit includes a blower for circulating air in the flow path.

23. The refrigerator of claim 22, wherein the heat discharging unit includes a heat conducting member in contact with the display unit and extends toward the front side of the door, for releasing heat generated from the display unit.

24. A refrigerator, comprising:

a main body provided with a storage compartment and a door for opening and closing the compartment;

a display unit installed on the door, for displaying an image on a screen, and a heat discharging unit installed at one side of the display unit, for releasing heat generated by the display unit, an accommodating portion recessed in the door and spaced apart from the display unit to form an air flow path for releasing heat flows, said heat discharging unit including a blower for circulating air in the flow path, a cover plate installed at a front surface of the door to cover a space between the display unit and the accommodating portion of the door, said cover plate including a first cover plate portion having a space therein and a second cover plate portion disposed in the space of the first cover plate portion so as to form a gap from the first cover plate and provided with an exposing portion where a screen of the display unit is exposed to the exterior.

25. A refrigerator, comprising:

a main body provide with a storage compartment and a door for opening and closing the compartment;

a display unit installed on the door, for displaying an image on a screen, and a heat discharging unit installed at one side of the display unit, for releasing heat generated by the display unit, wherein the display unit is installed at a distance from the door in order to form a flow path for air for releasing heat flow, the heat discharging unit including a blower for circulating air in the flow path and a heat conducting means installed adjacent to the display unit and extended toward a front surface of the door, for releasing heat generated from the display unit.

26. A refrigerator, comprising:

a main body provide with a storage compartment and a door for opening and closing the compartment;

a display unit installed on the door, for displaying an image on a screen, and a heat discharging unit installed at one side of the display unit, for releasing heat generated by the display unit said display unit being installed at a distance from an accommodating portion recessed in the door in order to form a flow path for air for releasing heat flows, and a cover plate is installed at a front surface of the door in order to cover a space between the display unit and the accommodating portion of the door, wherein the cover plate comprises:

a first cover plate portion having a space therein; and a second cover plate portion disposed in the space of the first cover plate so as to form a gap which communicates with the flow path.

* * * * *